US005528866A

United States Patent [19]

Yulkowski

[11] Patent Number: 5,528,866

[45] Date of Patent: Jun. 25, 1996

[54] METHOD AND APPARATUS FOR CONSTRUCTING MULTI-RISE STACKED MODULES FOR HUMAN OCCUPANCY

[76] Inventor: Patricia Yulkowski, 420 E. 89th St., New York, N.Y. 10128

[21] Appl. No.: 248,038

[22] Filed: May 24, 1994

[51] Int. Cl.[6] ..... E04H 1/04

[52] U.S. Cl. ..... 52/79.12; 52/79.2; 52/236.3; 52/79.13

[58] Field of Search ..... 52/79.2, 79.3, 52/79.12, 79.13, 236.3

[56] References Cited

U.S. PATENT DOCUMENTS

| | | | |
|---|---|---|---|
| 3,623,296 | 11/1971 | Santoro | 52/79.12 |
| 3,638,380 | 2/1972 | Perri . | |
| 3,721,056 | 3/1973 | Toan . | |
| 3,990,193 | 11/1976 | Ray et al. . | |
| 4,059,931 | 11/1977 | Mongon | 52/79.12 |

FOREIGN PATENT DOCUMENTS

| | | | |
|---|---|---|---|
| 20520 | 4/1972 | Australia . | |
| 2289686 | 5/1976 | France . | |
| 2207955 | 8/1973 | Germany . | |
| 2395621 | 12/1974 | Germany . | |
| 1067888 | 5/1967 | United Kingdom | 52/79.3 X |

OTHER PUBLICATIONS

*AIA Journal* –Apr..

*Primary Examiner*—Carl D. Friedman
*Assistant Examiner*—W. Glenn Edwards
*Attorney, Agent, or Firm*—David H. Semmes

[57] ABSTRACT

A multi-rise of stacked modules for human occupancy, particularly a method and apparatus for constructing a multi-rise of modules stacked about a central core. The method is characterized by developing support towers by positioning in each support tower a base support bracket having a rectilinear periphery, then telescoping complementary stacking brackets upon said base support bracket and upon each other, so as to develop individual structural columns extending vertically with each level of stacking brackets defining a superposed floor level. Support planks are then emplaced within the stacking brackets at each floor level in lateral array, prior to positioning modules upon the support planks such that each module is supported about a central core and retains a multi-sided outward view.

6 Claims, 7 Drawing Sheets

METHOD AND APPARATUS FOR CONSTRUCTING MULTI-RISE STACKED MODULES FOR HUMAN OCCUPANCY

CROSS-REFERENCE TO RELATED APPLICATIONS

None.

BACKGROUND OF THE INVENTION

1. Field of the Invention

Construction system for a multi-rise of modules for human occupancy, stacked in pinwheel array about a central core. The multi-rise is constructed by stacking support brackets as individual vertical columns and, in turn, dwelling modules, are supported within the brackets at floor level defined by the parallel brackets in each vertical column. The method of construction is characterized by its economy and simplicity. Also, the individual modules may be readily positioned and removed without affecting the structural integrity of the multi-rise structure. Since the modules are pre-fabricated, electrical and water services may be provided through hookup to vertically extending electrical and water service panels supported about a central open core. Applicant uses the term "dwelling module" to encompass a modular habitat for residence, office, manufacture or other human uses.

2. Description of the Prior Art

| | |
|---|---|
| 3,623,296 | SANTORO |
| 3,638,380 | PERRI |
| 3,721,056 | TOAN |
| 3,990,193 | RAY et al. |
| France | 2,289,686 |
| Germany | 2,207,955 |
| Germany | 2,325,621 |
| Great Britain | 2,052,070 |

The foregoing patents are discussed in an INFORMATION DISCLOSURE STATEMENT, being filed separately. Basically, the prior art multi-rises of dwelling modules are required to be supported by structural steel, embodying complex fastening of the dwelling modules to the structural steel, as well as the pouring of concrete footings. There is no suggestion of developing a plurality of individual support towers by means of telescoping brackets nor cantilevering dwelling modules and support planks within each floor, such that the modules are removably supported in superposed array about an enclosed core.

SUMMARY OF THE INVENTION

According to the present invention, a multi-rise of superposed modules is constructed by positioning a plurality of pads in lateral array upon a supporting base, then positioning base support brackets of rectilinear or other similar configuration which allows loads to converge at the base. The base support brackets provide an upper portion with vertically extending telescoping alignment guides. A telescoping tubular stacking bracket of complementary rectilinear configuration is placed upon each support bracket, so as to define a floor level above the base support bracket and, in turn, a plurality of stacking brackets is telescoped each upon the other, so as to develop a plurality of structural columns extending vertically from each pad with each level of parallel stacking brackets defining a superposed floor level. At each floor level, elongated support planks are supported within the stacking brackets in overlapping array, such that a dwelling support end of each plank is exposed to an end of an adjacent support plank. Then, dwelling modules of rectilinear cross-section are supported upon the planks, such that each dwelling module is positioned in lateral array about a central core.

DESCRIPTION OF THE DRAWINGS

FIG. 12 is an axonometric view, showing selective removal of a module by means of a crane or the like.

DESCRIPTION OF THE PREFERRED EMBODIMENTS

Figure 1:
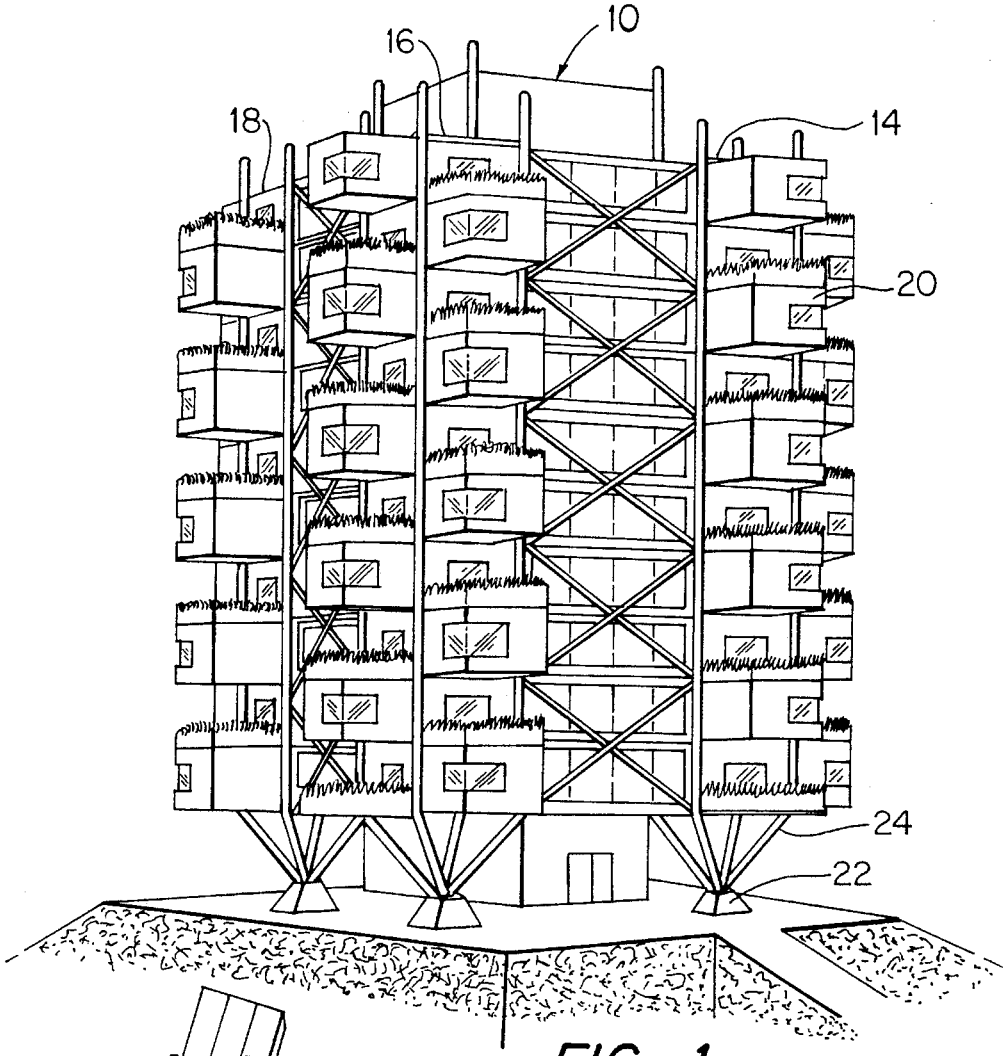
FIG. 1 is a perspective view of a multi-rise, embodying support towers of superposed and telescoping stacking brackets, supporting at each floor level modular units in lateral array.
Figure 2:
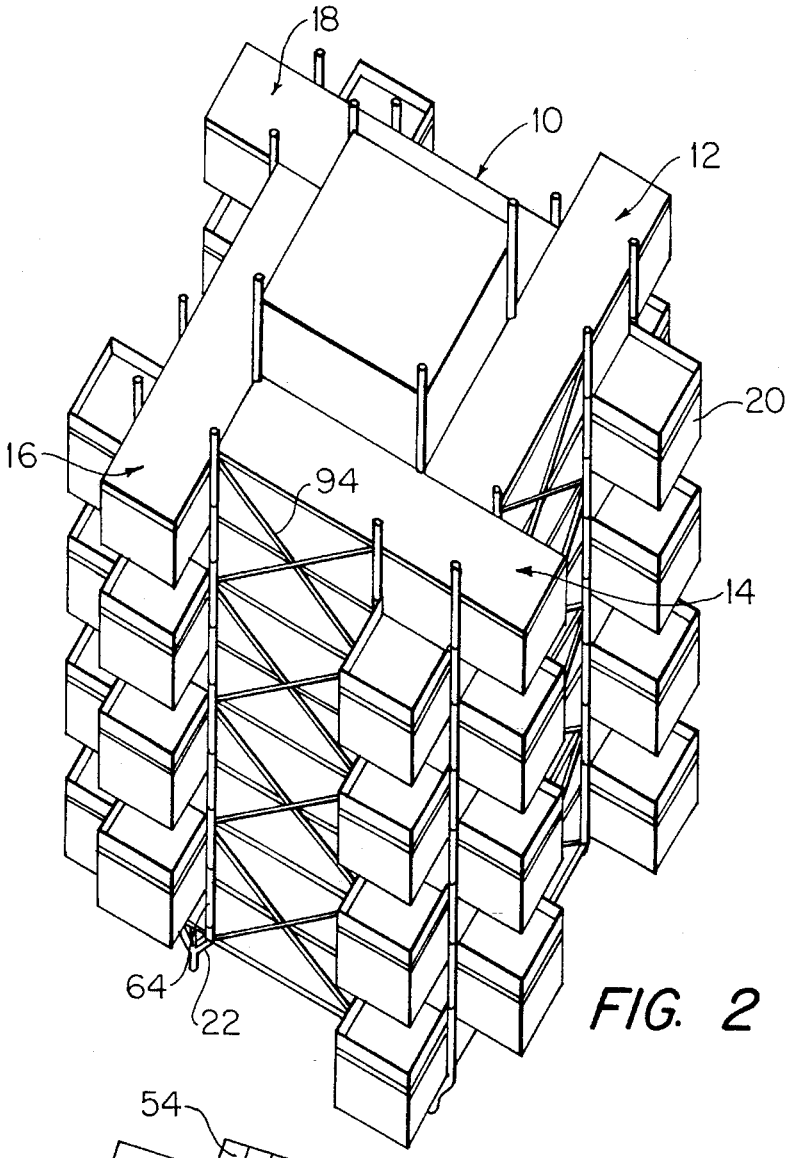
FIG. 2 is a an axonometric perspective of the above structure, showing the vertically extending stacking brackets and diagonally extending tensioning rods.

In FIG. 1 there is illustrated a multi-rise 10 of modules 20 superposed or stacked by means of support columns 12, 14, 16 and 18. Each support column is comprised of a conical or other similar base support bracket 24 positioned upon pad elements 22. As illustrated in FIG. 2, a plurality of telescoping stacking brackets 64, positioned one upon the other, so as to define floor levels above a ground floor/access level.

Figure 3:
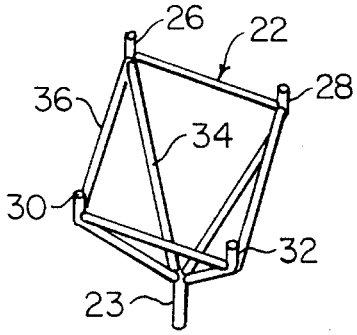
FIG. 3 is an axonometric view of a base support bracket of suggested rectilinear configuration with conical lower portion.
Figure 10:
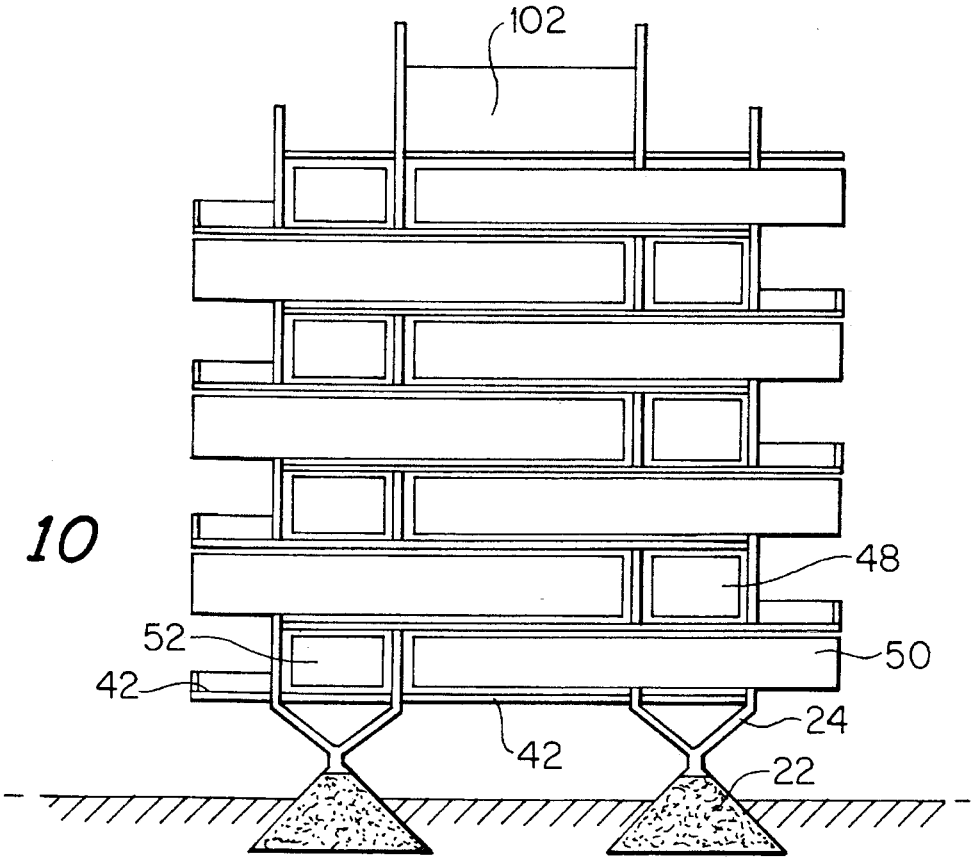
FIG. 10 is a vertical sectional view, taken along section line 10—10 of FIG. 9 and showing superposition of the modules through seven floors defined by the vertical columns of stacking brackets.
Figure 11:
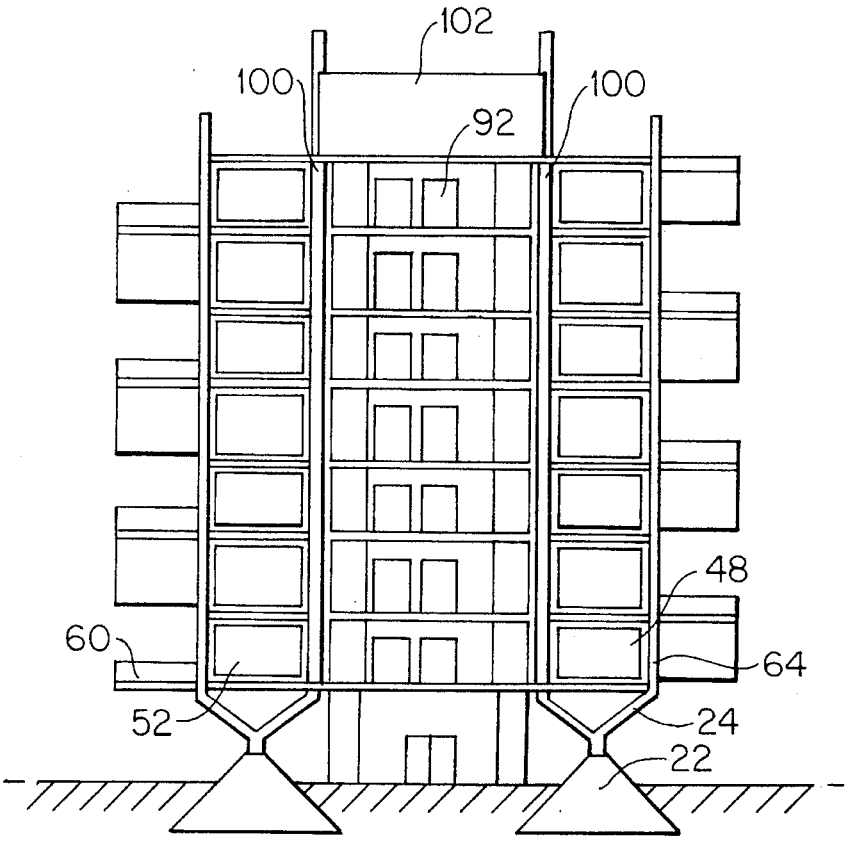
FIG. 11 is a vertical section, taken along section line 11—11 of FIG. 9, showing the module access to the electrical/mechanical service panels 100 at the central core of the multi-rise.

As illustrated in FIG. 3, conical support bracket 24 embodies vertically extending telescoping portions 26, 28, 30 and 32 secured to each other by means of identical horizontal strut 36. A downward extension 23 may be secured in pad element 22, as illustrated in FIGS. 10 and 11. The lower struts 34 extend downwardly from the telescoping portion 26, 28, 30 and 32 to converge at downward extension 23.

Figure 4:
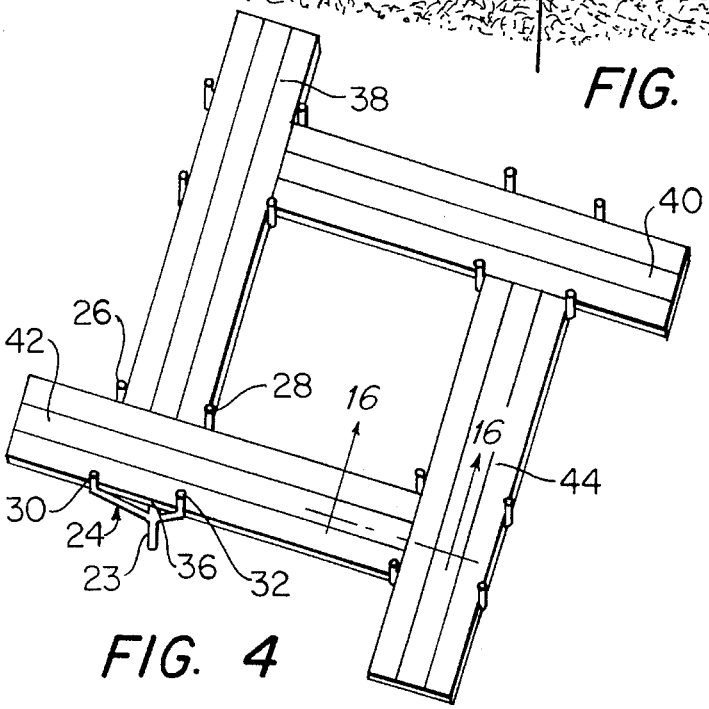
FIG. 4 is an axonometric view of the dwelling module support planks arranged in pinwheel array and supported upon the base support brackets at one floor level.
Figure 5:
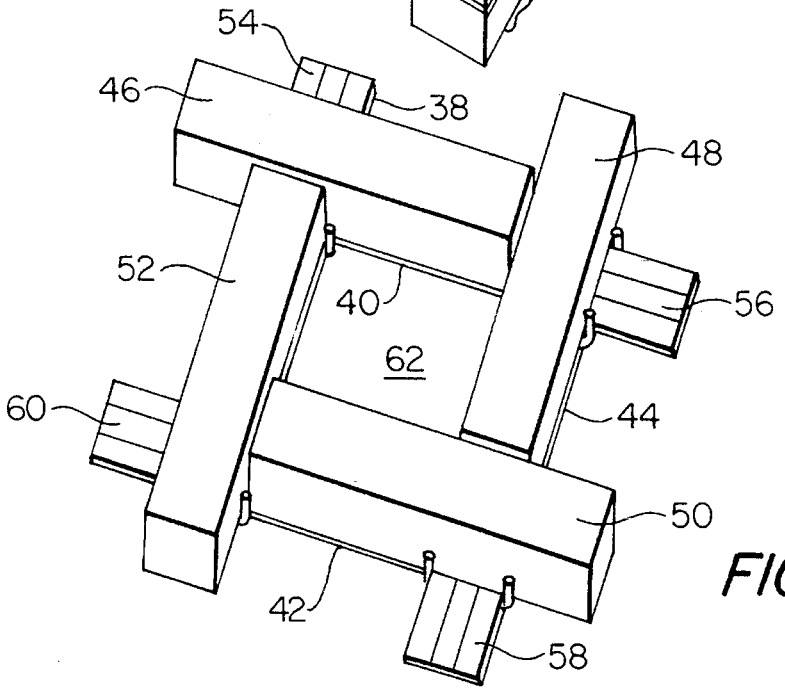
FIG. 5 is a perspective view, showing positioning of the dwelling modules 46, 48, 50 and 52 upon the respective support planks, having open ends 54, 56, 58 and 60 which serve as a porch for an adjacent dwelling module.

In FIG. 4 the second step of emplacing concrete planks 38, 40, 42 and 44 upon brackets 24 is illustrated. As will be apparent, the planks are in a lateral array, so as to support, in turn, emplaced modules 46, 48, 50 and 52, as illustrated in FIG. 5. These modules are placed in a cantilever fashion, such that an open end portion 54, 56, 58 and 60 of each plank may serve as a porch for the adjacent module.

Figure 6:
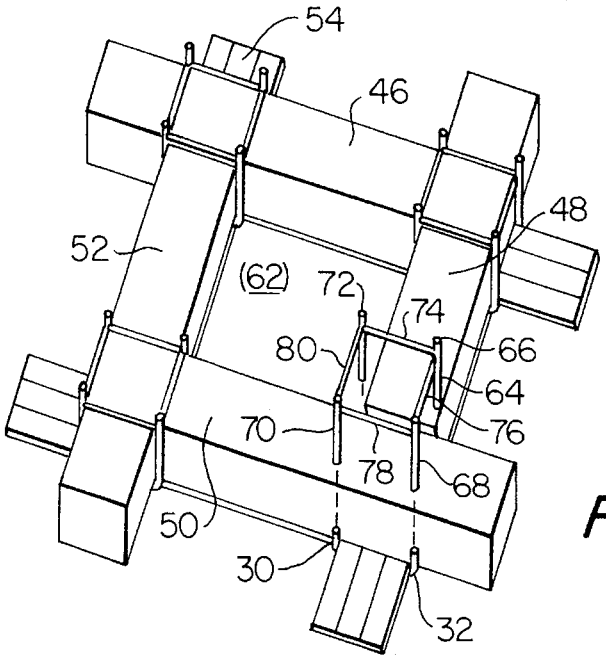
FIG. 6 is a schematic view showing placement of the rectilinear stacking brackets over the modules, so as to telescope/engage with the base support brackets.

In FIG. 6, there is illustrated the telescoping of stacking brackets 64 onto the individual base support brackets 24, so as to contain the positioned modules. Each stacking bracket 64 includes vertically extending corner telescoping sections 66, 68, 70 and 72, interconnected by horizontal support struts 74, 76, 78 and 80. As will be apparent, the lateral array of the modules defines inner core 62.

Figure 7:
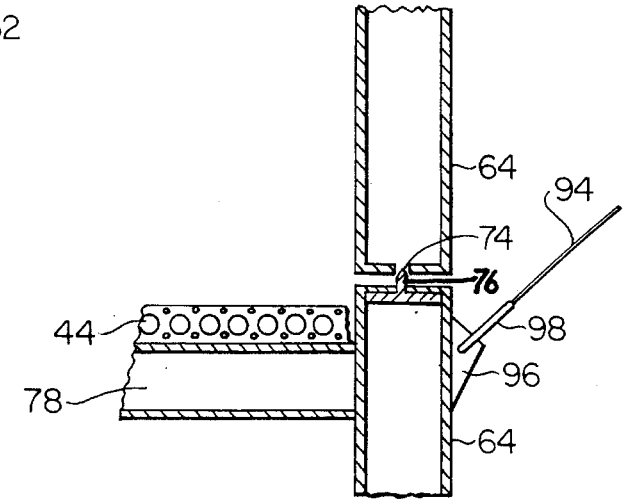
FIG. 7 is a fragmentary vertical section, showing a suggested embodiment for telescoping of the base support bracket and stacking brackets with respect to each other.
Figure 14:
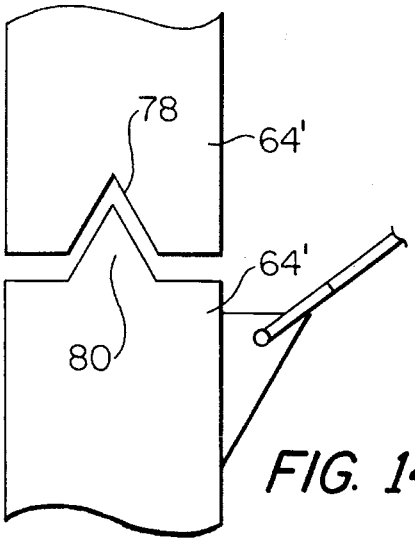
FIG. 14 is a fragmentary vertical section, showing alternative modes of telescoping and aligning stacking brackets.
Figure 15:
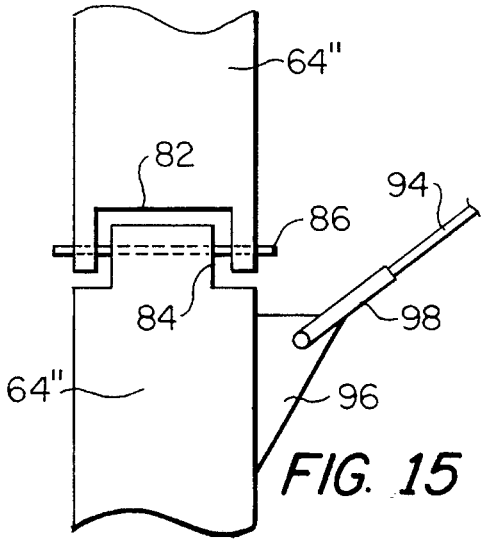
FIG. 15 is a fragmentary vertical section of a further modification showing stacking and aligning of stacking brackets 64' by means of circular complementary fittings 82, 84 held in place by a horizontal pin 86.
Figure 16:
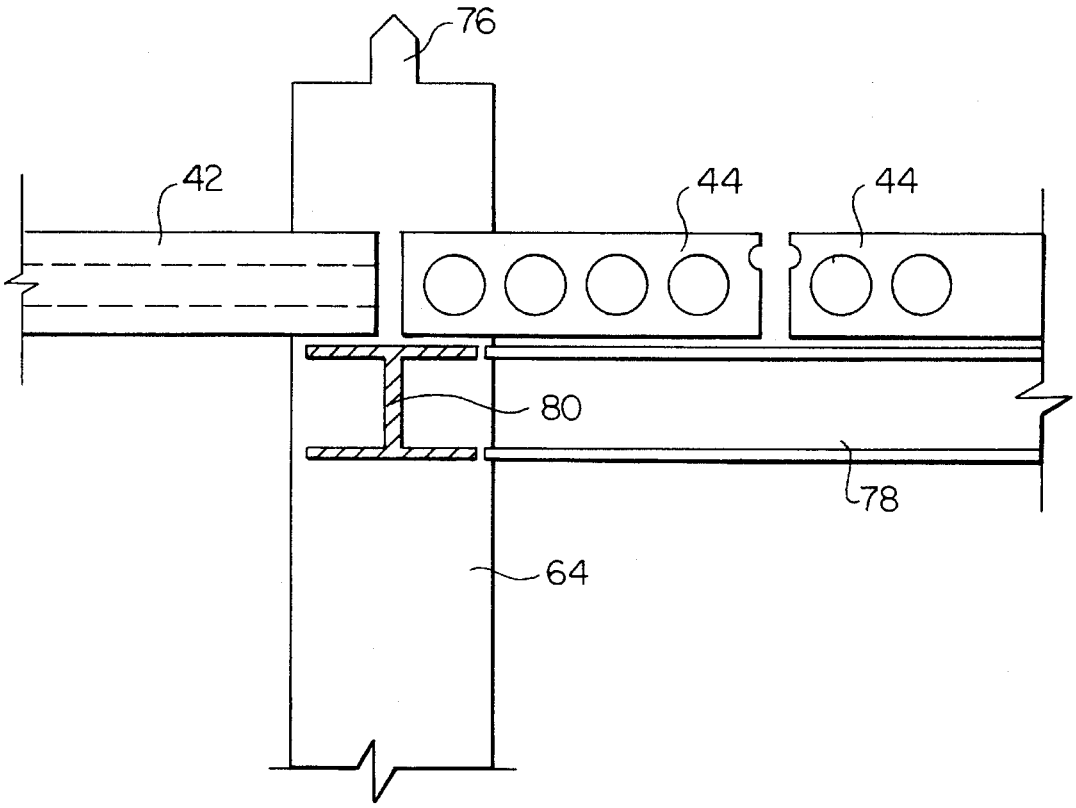
FIG. 16 is a fragmentary vertical section, taken along section line 16—16 of FIG. 4.

In FIGS. 7, 14 and 15, there is illustrated the method of telescoping the base support and stacking brackets. In FIG. 7, the precast concrete support plank 44 is illustrated as positioned upon horizontal support strut 78. Lower stacking bracket 64 includes vertically extending nipple 76 which engages aperture 74 in the upper stacking bracket 64. A tension rod 94 may be anchored to bracket 64 by turn-buckle or other conventional cable tensioning means 98 and flange 96. Tension rods 94 may extend diagonally, as illustrated in FIG. 2, from the stacking brackets on one level upwardly to an opposed stacking bracket on another dwelling level.

In the FIG. 14 telescoping modification, lower stacking bracket 64' employs pyramidal extension 80 to engage concavity 78 in upper stacking bracket 64' .

In the FIG. 15 modification, lower stacking bracket 64" telescoping portion includes vertical extension 84 which engages upper stacking bracket 64" circular concavity 82 and is secured by means of horizontal pin 86.

Figure 8:
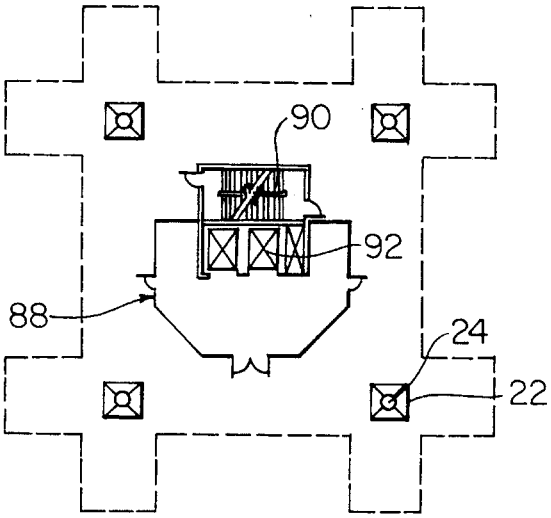
FIG. 8 is a ground floor plan view of the unit, showing a ground floor access in the form of a glazed lobby enclosure, together with stairway and vertical circulation components.

In FIG. 8 there is illustrated a ground floor plan with the outline of the building shown in dotted lines extending about pads 22. The plan embodies a ground access structure in the form of glazed lobby enclosure 88, stairs 90 and elevators or vertical circulation mechanism 92.

Figure 9:
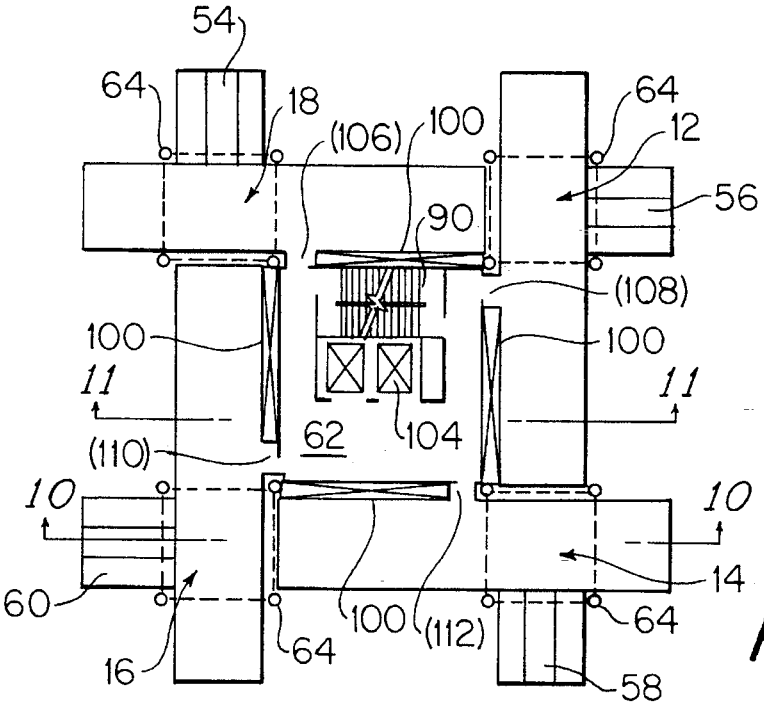
FIG. 9 is a plan view, showing emplacement of the vertically extending electrical/mechanical service walls 100 about a central core.

In FIG. 9, there is illustrated a typical floor plan wherein central core 62 is bounded by electrical/mechanical service panels 100, which provide doorway openings 106, 108, 110 and 112 into the individual modules.

In FIG. 10, there is illustrated the cantilevered positioning of the dwelling modules in lateral array with respect to each other and within the dwelling floor levels defined by the columns of stacking brackets.

In FIG. 11, there is illustrated the accessibility of the individual dwelling modules to the electrical/mechanical service panels 100 and elevators 92, as well as the defining of a mechanical services enclosure 102 at the top of core 62.

Figure 12:
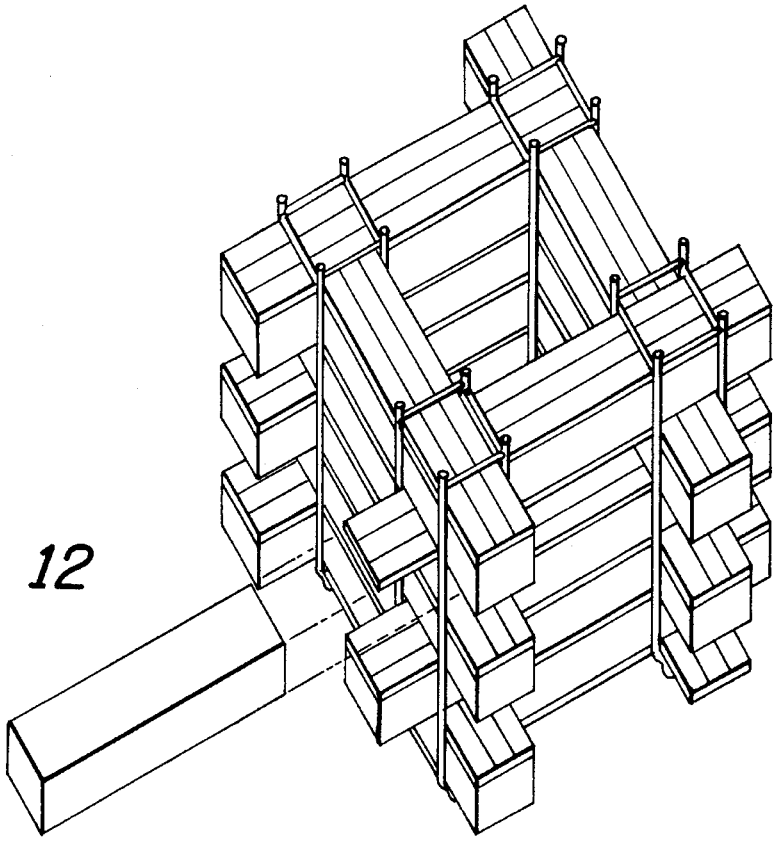

In FIG. 12, there is illustrated the completed multi-rise structure enabling removal and replacement of a dwelling module by means of a crane, or the like, without disturbing other dwelling modules or affecting the structural integrity of the multi-rise.

Figure 13:
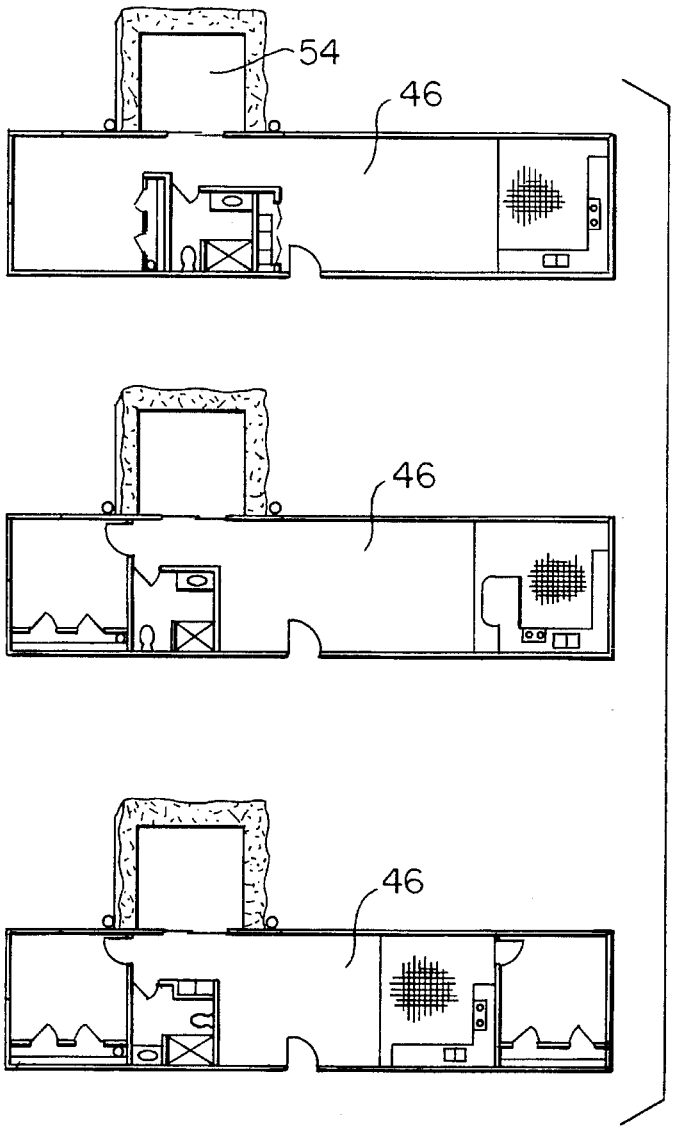
FIG. 13 is a series of plan views, suggesting alternative one and two bedroom dwelling module layouts.

In FIG. 13, there are illustrated variations in dwelling modules one and two bedroom floor plans.

Manifestly, the precast concrete dwelling support planks 38, 40, 42 and 44 may be pre-cambered by conventional means. Each module is completely self-sufficient with respect to electricity, water and gas, as it is hooked up to service panel 100. The lateral array of dwelling units enables access to central enclosed core 62 and service panels 100, as well as outward exposure of the dwelling modules in multiple directions. The factory construction of tubular support and stacking brackets in the form of steel pipe which may or may not be filled with concrete, enables on- site erection by means of a crane or the like and without welding or riveting. Similarly, disassembly is facilitated. Support towers 12, 14, 16 and 18 may be braced by tension rods 94 extending diagonally between the stacking brackets and, also, by the individual support planks extending through the stacking brackets.

The footprint of the structure embodying pads 22 and lobby 88, would require only 20 to 25% of conventional ground level space, enabling utilization of the building site both for interior access and exterior recreational purposes. The use of precast concrete in the support planks inhibits sound transmission through the floor levels and also, could provide a balcony extension for each module. Also, the independent support of the modules upon planks 38, 40, 42, and 44, facilitates removal for modification or replacement by means of a crane or the like. An infrastructure of electrical, mechanical air conditioning, and plumbing service may be provided in service panels or chase 100, thereby eliminating the necessity for complex plumbing, wiring and ducting, as in conventional buildings. Since the individual dwelling modules are non-bearing, they may be removed without damage to each other and without affecting structural integrity of the multi-rise. In a typical construction, the multi-rise building could be built within a 90 foot quadrangle, while providing seven dwelling floors in a vertical elevation of approximately 114 feet.

As will be apparent, there are no modules on the first or ground floor, which is reserved for providing access with an open and unobtrusive feeling. A transparent enclosure of the lobby over approximately 33 by 33 feet, could be provided to ensure a feeling of openness and safety. In a suggested floor plan, there are only four units per floor, such that each module may have outward exposure in three directions, providing a feeling of openness without confinement, while maintaining a minimally sized central core 62. Also, party walls have been eliminated since no one wall is shared by two modules, thus, maximizing sound insulation and allowing each module to have requisite peace and quiet.

In FIG. 13 the illustrated floor plans of dwelling modules, each include a 196 square foot balcony. The suggested dwelling module would include built-in washer, dryer, dishwasher, refrigerator, stove, hot water heater, HVAC system, sprinkler system, cabinets, carpet, tile work, shower, toilet, sink, and the like.

It is an object of invention to derive the benefits accruing from a combination of support towers, together with stackable, modular prefabricated modules in a method of construction which requires minimum footprint. The pre-manufacture of both support brackets and modules eliminates expensive and time consuming field labor and, in addition, results in quantum reductions in final costs, making ownership available to many levels of income.

Manifestly, the multi-rise is designed to permit:

A. Removal and or refurbishment of individual modules which have been damaged or abused.

B. Economic disassembly of the entire multi-rise structure for movement to a new location, since the structural system is assembled without relying upon welding, riveting or permanent fastenings.

C. Replacement or modification of dwelling modules every 15 to 25 years without affecting utilities service or structural integrity of the multi-rise.

I claim:

1. Method of constructing stacked modules for human occupancy comprising:

a. positioning a plurality of support pads in an array upon a supporting base;

b. positioning a plurality of tubular base support brackets having a rectilinear periphery with vertically extending telescoping guides upon said support pads;

c. telescoping tubular stacking brackets of complementary rectilinear periphery and vertically extending telescoping guides, so as to engage said base support bracket telescoping guides and define a floor level above said base support brackets and in turn telescoping a plurality of stacking brackets each upon the other so as to develop structural columns extending vertically from each support pad with each level of stacking brackets defining a superposed floor level; and d. positioning modules upon said support brackets such that each module is supported in lateral array about a central core, while retaining a multi-sided outward view;

e. emplacing elongated support planks within said stacking brackets at each floor level and in lateral array, such that a module support end of each plank engages an end of an adjacent module support plank;

f. constructing vertically extending mechanical and electrical service panels intermediate the structural columns as faces of said inner core, so as to be operably connectable to said modules, and g. tensioning said tubular stacking brackets and the structural columns with respect to each other.

2. Method of constructing stacked modules for human occupancy as in claim 1, including positioning a ground floor access intermediate said base support brackets.

3. Method of constructing stacked modules for human occupancy as in claim 2 wherein an end of each module support plank defines an outer porch area for a module positioned thereon.

4. Method of constructing stacked modules for human occupancy as in claim 2, wherein an open end of at least one module defines an outer porch area for a module superposed thereon.

5. A multi-rise of stacked modules for human occupancy comprising:

a. a plurality of support pads positioned in an array upon a supporting surface;

b. support towers extending vertically from each support pad and including:

i) a tubular base support bracket of rectilinear periphery with vertically extending aligning guides at each corner, said tubular base support bracket being constructed of concrete filled pipe;

ii) a plurality of superposed tubular stacking brackets of complementary rectilinear configuration supported upon each support bracket, each stacking bracket being constructed of concrete filled pipe and defining a floor level and further including:

a) telescoping portions extending vertically at each rectilinear corner, so as to engage complementally telescoping portions of said base support bracket and complementary telescoping portions of superposed stacking brackets;

b) a support strut interconnecting said tubular telescoping portions of each stacking bracket adjacent an upper end;

c. a plurality of module support planks extending through said tubular stacking brackets and supported by said support strut at each module floor level, said module support plank abutting at one end by an adjacent module support plank, such that said module support planks extending through said stacking brackets are positioned in lateral interlocking array at each floor level; and d. a dwelling module of rectilinier cross-section supported upon said support plank at each floor level, so as to define a central core and wherein at least one said dwelling module is laterally contained by said tubular stacking bracket telescoping portion and wherein each said dwelling module includes independent utilities;

f. vertically extending electrical and mechanical surface panels extending between adjacent support towers about said central core, so as to be accessible to a module at each floor level;

g. a ground level access structure defined adjacent said support pads and beneath tubular stacking brackets, so as to extend upwardly into a first module floor level, and h. tensioning rods extending diagonally from said stacking brackets in one support tower to said stacking brackets in another support tower.

6. A multi-rise of stacked modules for human occupancy as in claim 5, wherein said dwelling modules include independent utilities.

* * * * *